US005417291A

United States Patent [19]

Leising

[11] Patent Number: 5,417,291

[45] Date of Patent: May 23, 1995

[54] DRILLING CONNECTOR

[75] Inventor: Lawrence J. Leising, Broken Arrow, Okla.

[73] Assignee: Dowell, a division of Schlumberger Technology Corporation, Houston, Tex.

[21] Appl. No.: 62,645

[22] Filed: May 14, 1993

[51] Int. Cl.[6] ..... E21B 17/046

[52] U.S. Cl. ..... 175/320; 166/184

[58] Field of Search ..... 166/55.1, 301, 386, 166/383, 184; 175/320, 321

[56] References Cited

U.S. PATENT DOCUMENTS

| | | | |
|---|---|---|---|
| 3,329,221 | 7/1967 | Walker | 175/321 |
| 3,834,472 | 9/1974 | Perkins | 175/321 |
| 4,054,040 | 10/1977 | Medders | 175/321 X |
| 4,378,057 | 3/1983 | O'Connell | 175/320 X |
| 4,917,191 | 4/1990 | Hopmann et al. | 166/381 |
| 4,928,772 | 5/1990 | Hopmann | 166/386 |
| 4,953,640 | 9/1990 | Kurt | 175/320 |
| 5,215,151 | 6/1993 | Smith et al. | 175/45 |

*Primary Examiner*—Ramon S. Britts

*Assistant Examiner*—Frank S. Tsay

*Attorney, Agent, or Firm*—Henry N. Garrana; Stephen A. Littlefield

[57] ABSTRACT

A tubular connector for connecting a drilling tool assembly to a drill string for use in CTD operations. The connector has a fluid flow passage therethrough, and comprises: a first part connected to the drill string and a second part connected to the drilling tool assembly; inter engaging formations such as splines provided on the first and second parts such that, when engaged, the formations do not prevent relative axial movement of the first and second parts but prevent relative rotation thereof; a threaded collar provided around adjacent end portions of the first and second parts for axial location thereof when connected. The connector can also include a non-return valve assembly located in the fluid flow passage; a pressure actuated piston device in the fluid flow passage for disconnecting the drilling tool assembly from the chill string; and a pressure actuated valve which, when operated, allows fluid communication between the fluid flow passage and an exterior region of the connector.

17 Claims, 3 Drawing Sheets

DRILLING CONNECTOR

FIELD OF THE INVENTION

The present invention relates m a connector for connecting a drilling tool assembly to a drill string. In particular the invention relates to a connector for connecting a bottom hole assembly (BHA) to coiled tubing (CT) for coiled tubing drilling (CTD) operations.

BACKGROUND OF THE INVENTION

In CTD operations, a BHA comprising, inter alia, a downhole motor having a drill bit connected thereto is made up to a CT string and drilling takes place by rotating the bit with the downhole motor by pumping drilling fluid through the CT and applying weight to the bit. In this respect, CTD operations are essentially the same as conventional drilling operations with a downhole motor and drill pipe forming the drill string. However, since CT is continuous, it is not necessary for the drilling to be interrupted to add more pipe to lengthen the drill string. In CTD operations the CT drill string is advanced into the well or withdrawn from the well using a CT injector head as is common in CT operations. Consequently, it is unnecessary to have a derrick or mast, draw works and rotary table or top drive to handle or drive the drill string as in conventional rotary drilling.

In drilling operations, the drill string and. BHA can become stuck for a variety of reasons which are generally considered as mechanical sticking or differential sticking. In such cases, the overpull required to free the drill string or BHA is greater than that available from the rig. While certain remedial operations are available, it is often the case that it becomes necessary to back off and to retrieve the stuck tool in a fishing operation. With a conventional pipe drill swing, this is done by locating the stuck point in the drill string with an appropriate wireline tool inside the drill string and then lowering an explosive charge to the level of the pipe joint above the stuck point. This charge is detonated while a torque is applied to the swing to unscrew this joint and allow the free part of the drill string to be withdrawn from the well. CTD operations differ in that there are no pipe joints to disconnect nor is it normally possible to apply torque to the drill swing since there is no rotary drive at the surface. In addition, running in of a wireline tool or explosive cutter would require first cutting the CT at the surface. Sticking is encountered in non-drilling CT operations and it is normally the tools connected to the CT which become stuck. Consequently, the connector often includes a disconnect mechanism which can be actuated by pumping fluid through the CT, often in conjunction with dropping a ball into a ball seat in the connector to block the flow passage and allow sufficient pressures to be generated to operate the disconnect.

Generally it is the BHA which becomes stuck in CTD operations but conventional CT connectors are inappropriate for drilling operations because they involve a threaded connection. While this is acceptable for non-drilling applications where there is no torque on the joint in the connector, it is not suitable for CTD operations since the drilling action causes torque to be applied to the BHA and CT. In conventional drilling operations threaded joints can be tightened to an appropriate torque using the rotary power available at the rig floor, rotating the drill string, the new pipe or both. However, such rotary power is not normally available in CTD operations nor is it normally possible to rotate the drill string. All threaded connections may be made up with power tongs, except the final one where the injector is made up to the BHA preventing the use of power tongs.

The lack of rotary power to apply the torque typically required for conventional threaded joints (often in the order of 2000 ft lbs) and the inability to rotate the CT has been encountered before in CT operations and joints which do not require rotation of the CT or tool have been proposed. These generally involve threaded rotatable collars on one pan of the connector which engage threaded portions on the other pan such that when tightened, the two pans are drawn together. However, such joints are not capable of transmitting drilling torque across the joint but this is not a problem in conventional operations where negligible torque is encountered.

It is an object of the present invention to provide a connector suitable for CTD operations which does not require high levels of torque to make the connection yet which is able to transmit the torque encountered in drilling across the joint.

SUMMARY OF THE INVENTION

The present invention provides a tubular connector for connecting a drilling tool assembly to a drill string having a fluid flow passage therethrough, comprising: a first pan including means for fixing to the drill string and a second pan including means for fixing to the drilling tool assembly; inter engaging formations provided on the first and second pans such that, when engaged, said formations do not prevent relative axial movement of the first and second parts but prevent relative rotation thereof; a threaded collar provided around adjacent end portions of the first and second parts for axial location thereof when connected.

It is preferred that the connector also includes a non-return valve assembly located in the fluid flow passage; a pressure actuated piston device in the fluid flow passage for disconnecting the drilling tool assembly from the drill string; and a pressure actuated valve which, when operated, allows fluid communication between the fluid flow passage and an exterior region of the connector.

The provision of the inter engaging formations, typically splines, in the two parts of the connector allows the parts to be "stabbed" together, i.e. the end of one part is inserted into the end of the other pan, and the collar can then be tightened around the joint. Since the collar does not carry any of the torque, it is not required to be tightened with a high torque and so can be completed with the facilities typically at hand in a CTD operation such as a pipe wrench without the need for rotation of the parts themselves.

The pressure actuated piston device serves to connect two separable pans of the connector. These two pans are typically found in one or other of the first or second pan of the connector. In one example, the second pan of the connector is formed from two separable parts held together by the piston device. When it is desired to disconnect the drill string from the drilling tool assembly, the piston device will be actuated so that the two pans can be separated.

BRIEF DESCRIPTION OF THE INVENTION

The present invention will now be described in more detail with reference to the accompanying drawings, in which.

DETAILED DESCRIPTION OF A PREFERRED EMBODIMENT

Figure 1:
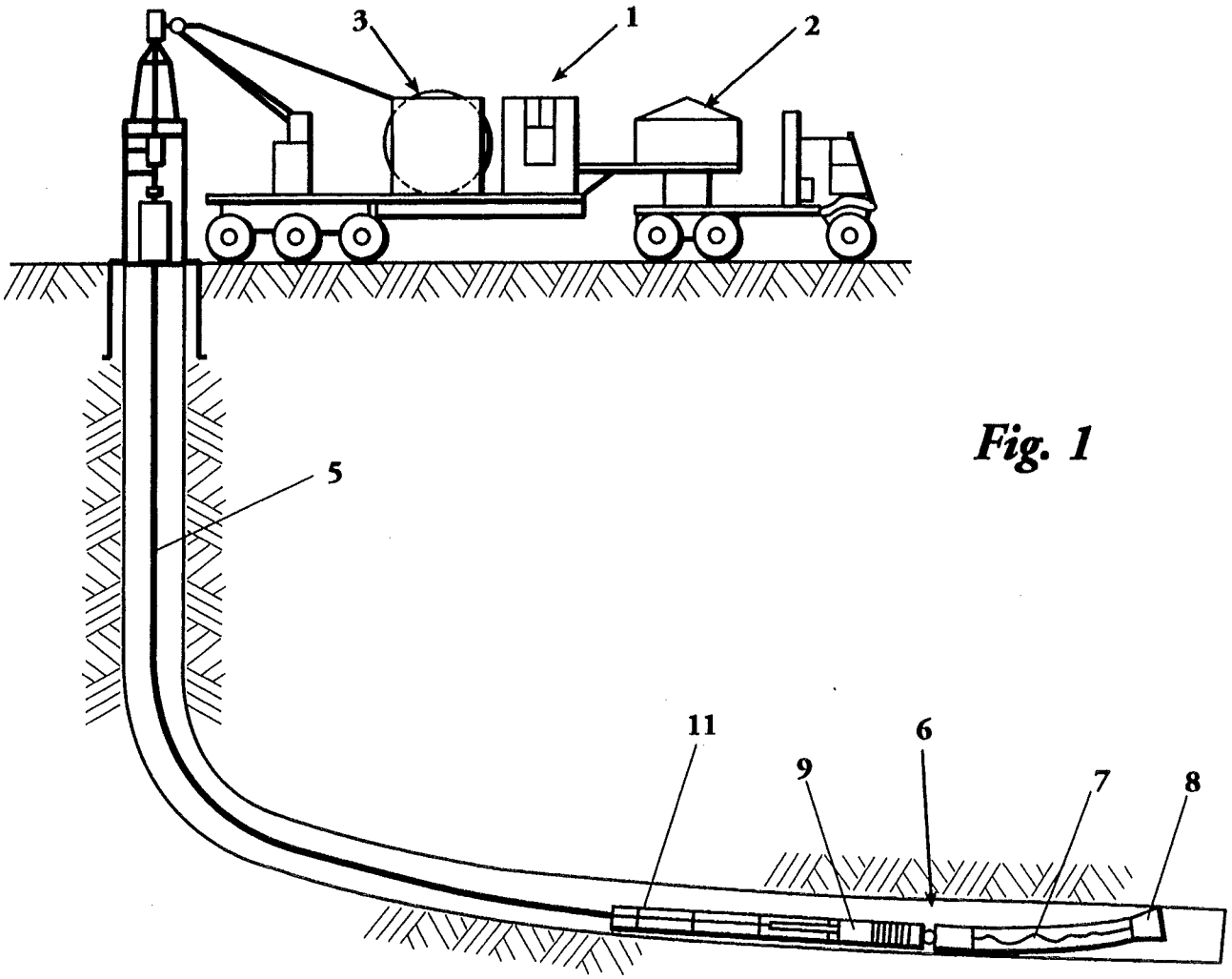
FIG. 1 shows a general view of a CTD operation.

Referring now to FIG. 1, there is shown a schematic view of a CTD operation. The surface equipment comprises a track mounted CT unit 1 having a power source 2 and CT reel 3 mounted thereon. The CT 5 passes into the well via a CT injector head 4 which incorporates blowout preventers. At the lower end of the CT is mounted a bottom hole assembly 6 incorporating a downhole motor 7, a drill bit 8 and an MWD package 9. The BHA is connected to the CT by means of a connector 11 which will be described in detail below in relation to FIGS. 2–5.

Figure 2:
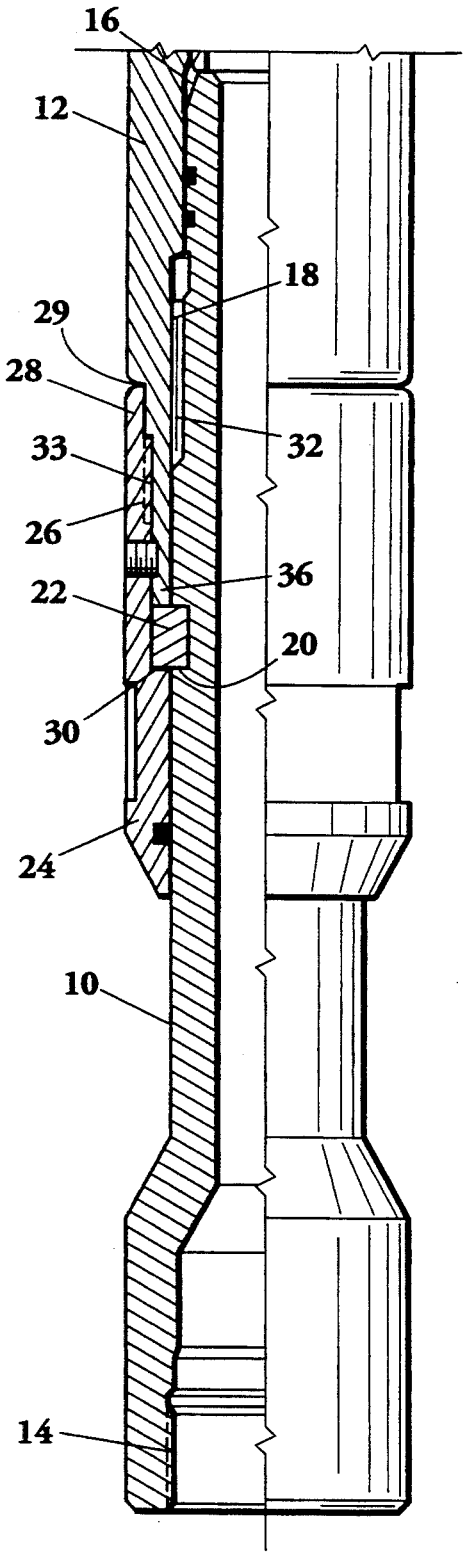
FIGS. 2–5 show sectioned views through a connector according to one embodiment of the invention.

The connector shown in FIGS. 2–5 comprises a generally tubular body having a first section 10 connected to a coiled tube not shown) and a second section 12 connected to a bottom hole assembly (also not shown) Unless otherwise indicated, the parts of the connector are made from alloy steel or any other material as is commonly used for oilfield tools such as these. Referring now to FIG. 2, the first section 10 is made from a corrosion resistant metal and chromium alloy (INCONEL 718) and is connected to the coiled tube by a conventional CT tool connector (not shown) which fits into a threaded end fitting 14 which is typically tightened to a torque of 2000 ft lbs. The portion of the fast section 10 beyond the end fitting 14 is reduced in diameter and has a tapered end 16 and splines 18 formed in the outer surface of the section adjacent the tapered end 16. A groove 20 is formed in the outer surface of the first section 10 near to the splines 18 and a split ring 22 made from a corrosion metal and chromium alloy (MONEL K500) is located in the groove 20 so as to provide abutment surfaces proud of the surface of the section 10. A collar 24 is located around the reduced diameter portion of the first section 10 and has a threaded portion 26 on its inner surface near an open end 28. A shoulder 30 is formed in the inner surface of the collar 24 which, at one limit of the axial movement of the collar 24 on the section 10 abuts against the ring 22.

The end of the second section 12 is reduced in diameter and thickness and has splines 32 formed in the inner surface thereof and a threaded portion 33 in the outer surface thereof.

In use, the tapered end 16 of the, first section 10 is stabbed into the end portion of the second section 12 such that the splines 18, 32 engage. Tapered lead-in sections are provided on the splines to assist in alignment and engagement. The collar 24 is then slid down over the end portion of the second section 12 and the threaded portions 26, 33 are engaged and tightened until the shoulder 30 and the end surface 36 of the second section each contact the ring 22. The collar is the tightened to a torque of about 400 ft lbs which can typically be applied using a pipe wrench or the like. The collar 24 is retained in tightened position by set screws 25. Relative axial movement of the first and second sections is prevented by the collar 24 and ring 22 and relative rotation of the first and second sections is prevented by the splines 18, 32. In an alternative embodiment, the ring 22 only serves to retain the collar on the first section 10 and axial thrust is taken by the collar. The limit of this is found when the end 28 is tightened against a shoulder 29 in the second part 12.

Figure 3:
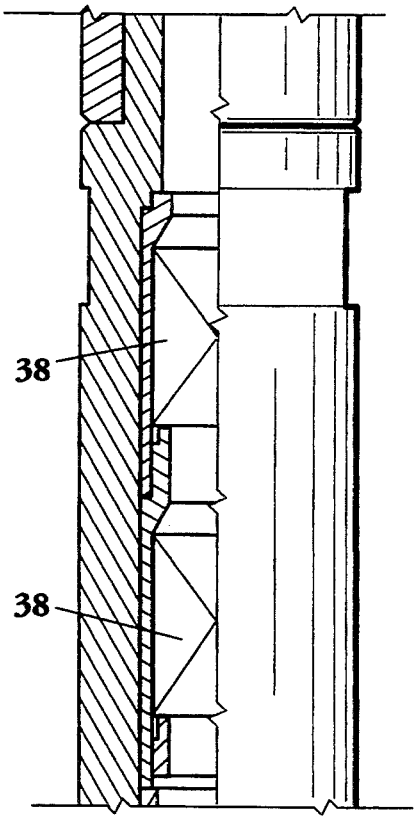

Double check valves 38 are mounted in the second section adjacent the end portion as is shown in FIG. 3. The check valves act as non-return valves such that flow of drilling fluid from the CT to the BHA is allowed but flow in the reverse direction is prevented. Such valves are commonly used in CT and drilling operations for this purpose and are available from a number of suppliers.

Figure 4:
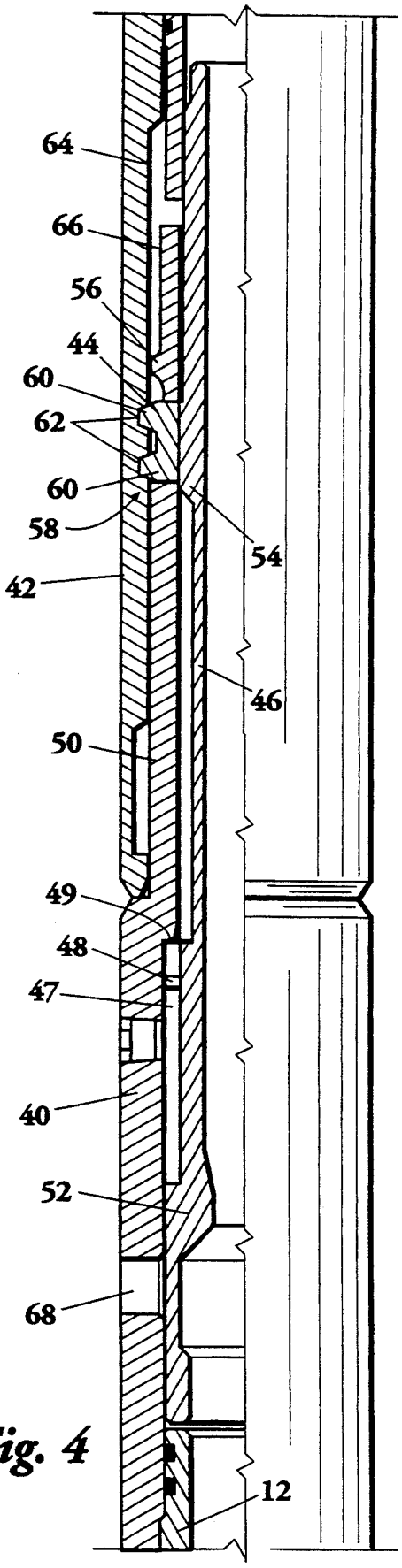

Adjacent the check valves and shown in FIG. 4, is a pressure operated disconnect section. This comprises upper and lower separable parts 40, 42 made from alloy steel which are held together by means of three lugs .44 (only one is shown). The upper part 42 is connected to the second part 12. The lugs 44 are held in engagement with the separable parts by means of a slideable piston 46 located in the interior of the section and held against axial movement by a series of shear pins 48 (only one is shown) held in a shear sleeve 47 which fits against a shoulder 49 formed in the inner surface of the first part 40 and which connect the piston to the upper part 40. The upper part 40 has an end section 50 of reduced diameter which fits inside the end section of the lower part 42. The inner surface of the lower part 42 adjacent its open end is undercut to provide a suitable connection for a fishing tool after separation.

The piston 46 comprises an essentially cylindrical body having a reduced diameter central bore at its upper end forming a ball seat 52. The outer surface of the piston 46 at its lower end forms a lug support 54 which serves to retain the lugs 44 in position so as to project through apertures 56 in the section 50 into lug seats 58 in the inner surface of the lower pan 42. The lugs are formed with two projections 60 which locate into two correspondingly shaped recesses 62 in the lug seat 58. The provision of the two projections 60 means that axial load in either direction is spread over twice the area than would be the case if a single projection was provided on a similar sized lug. Relative rotation of the upper and lower parts 40,42 is prevented by means of inter engaging splines 64, 66 formed in the outer and inner surfaces of the parts 40,42. The portion of the piston 46 between the ball seat 52 and the lug support 54 has a reduced outer diameter such that when this portion is positioned below the lugs 44, they can fall out of engagement with the lug seats 58 and allow relative axial separation of the two parts of the disconnect section. The piston 46 is made as light as possible to reduce the likelihood of shearing the shear pins accidentally by axial shock applied to the connector.

Operation of the disconnect section is achieved by dropping a steel ball through the CT so as to become located in the seat 52. Once located, the pressure of the drilling fluid is raised such that the shear pins 48 break and the piston 46 is forced down by the pressure of the drilling fluid. This in turn moves the portion of reduced outer diameter below the lugs 44 such that they can drop out of engagement with the lug seats 58 and the two parts can be separated by pulling the CT at the surface. At the same time, the portion of the piston forming the ball seat 52 opens a port 68 in the upper part 40 which allows drilling fluid to pass from the interior of the CT and connector to the exterior thereof. Consequently, circulation of drilling fluid through the CT can continue while it is being withdrawn from the well despite the fact that the ball is blocking the normal flow channel. This can be particularly useful when disconnecting in very cold environments where the drilling fluid might otherwise freeze in the CT reel at the surface if not circulated continuously.

Figure 5:
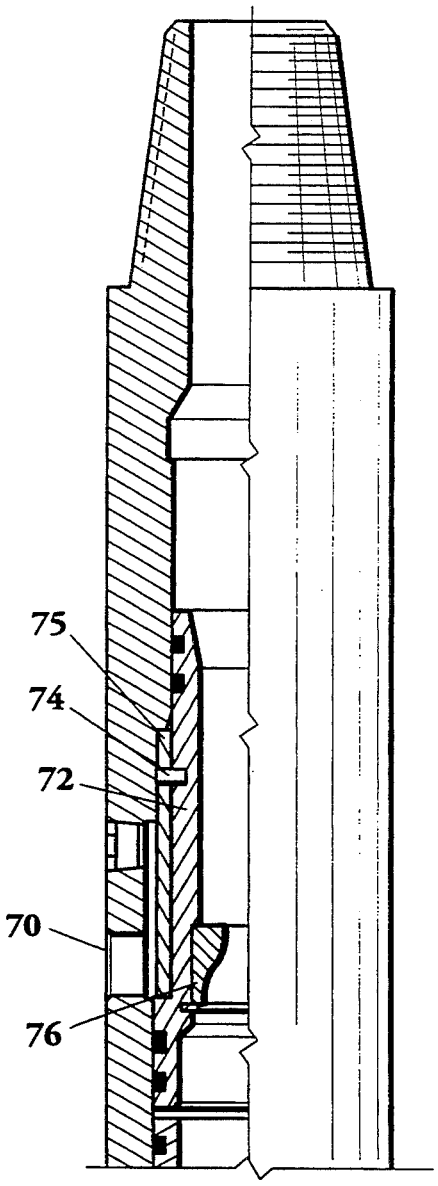

Below the disconnect is a pressure operated circulation valve section as shown in FIG. 5. This comprises a port 70 in the lower section 42 which is covered by a sliding piston valve member 72 which is similar to that in the disconnect section. The valve member 72 is made from a corrosion resistant nickel alloy MONEL K500 and is held in place over the port 70 by means of shear pins 74 (only one shown) and a shear sleeve 75. A flow restriction 76 is formed in the bore of the valve member 72 which can also serve as a ball seat. The restriction 76 is typically made from tungsten carbide and is similar in structure to a bit nozzle. In use, the port 70 can be opened by either increasing the pressure of the drilling fluid in the CT such that the force exerted on the piston 72 due to the differential area YY-ZZ is sufficient to break the shear pins 74 or circulating a ball through the CT which will seat in the restriction 76 and allow pressure to build up and break the shear pins 74. In either case, the valve member slides down to open the port 70 and allow circulation of the drilling fluid to continue. This can be important for three particular reasons. First, when it is desired to circulate while withdrawing the BHA from the well in cold climates to prevent freezing of the drilling fluid in the CT reel. Since drilling is performed with a downhole motor which uses flow of drilling fluid to drive the drill bit, continued flowing of fluid when tripping out of hole would normally continue to rotate the drill bit which is undesirable due to the reaming action which would occur. In such a case, a ball would normally be used to operate the valve and block the flow to the motor. Second, if the nozzles in the bit are blocked such that flow through the CT is not possible, it will not be possible to circulate a ball to operate the disconnect as described above. By opening the port 70, circulation can be resumed and the ball dropped into the disconnect. Third, if it is necessary to circulate lost circulation material which might otherwise plug an MWD tool or drill bit, the port 70 can be opened prior to circulation of this material.

Below the valve section, the connector terminates in a conventional tapered thread section which can be connected to a BHA in the normal way.

Since the valve section must be placed below the disconnect section, it is essential that the pressure required to operate the valve is less than that which would actuate the disconnect. Furthermore, the ball used to actuate the valve must be able to pass through the disconnect ball seat. In one example of the present invention, for a 3 in diameter connector, the valve uses a 0.625 in ball and a pressure of 1891 psi for actuation while the disconnect uses a 0.875 ball and 2700 psi to disconnect. Where no ball is used, the valve is actuated at 5600 psi and the disconnect will not normally operate without a ball at pressures below 7100 psi. These settings can be adjusted by changing the number of shear pins, their thickness or the differential areas forming the ball seats or restrictions as will be appreciated by a worker skilled in the art.

What is claimed is:

1. A tubular connector for connecting a drilling tool assembly to a drill string having a fluid flow passage therethrough, comprising: a first part including means for attachment to the drill string and a second part including means for attachment to the drilling tool assembly; the first and second parts including inter engaging portions which allow relative axial movement of the first and second parts but prevent relative rotation thereof; a threaded collar provided around adjacent end portions of the first and second parts which prevents axial movement therebetween when connected; a non-return valve assembly located in the fluid flow passage; a pressure actuated piston device in the fluid flow passage for disconnecting the drilling tool assembly from the drill string; and a pressure actuated valve which, when operated, allows fluid communication between the fluid flow passage and an exterior region of the connector.

2. A tubular connector as claimed in claim 1, further comprising abutment means comprising for carrying an axial thrust between the first and second parts caused by tightening of the threaded collar.

3. A tubular connector as claimed in claim 1, wherein the second part includes the non-return valve assembly, the pressure actuated piston device and the pressure actuated valve.

4. A tubular connector as claimed in claim 1, wherein the pressure actuated piston device in its normal position serves to connect portions of the tubular connector and when actuated allows axial separation of the portions.

5. A tubular connector as claimed in claim 4, wherein the pressure actuated piston device is held in position by shear pins.

6. A tubular connector as claimed in claim 4, wherein the separable portions of the tubular connector are held against axial separation by lugs when the pressure actuated piston device is in position.

7. A tubular connector as claimed in claim 4, wherein the separable portion which is connected to the drilling tool assembly includes means for engagement with a fishing tool.

8. A tubular connector as claimed in claim 5, wherein the pressure actuated piston device includes a ball seat such that when a ball is located in the ball seat, pressure can be applied to shear the shear pins and allow separation of the separable portions.

9. A tubular connector as claimed in claim 6, wherein the separable portions are held against relative rotation by inter engaging splines.

10. A tubular connector as claimed in claim 8 wherein actuation of the device opens a port in a portion of the connector connected to the drill string such that fluid can be circulated through the drill string after separation with the ball located in the ball seat.

11. A tubular connector as claimed in claim 1, wherein the pressure actuated valve comprises a sleeve in the fluid flow passage by means of shear pins, the sleeve including a flow restriction.

12. A tubular connector as claimed in claim 11, wherein the flow restriction also includes a ball seat.

13. A tubular connector as claimed in claim 1, wherein the pressure actuated piston device is located downstream in the direction of fluid flow in the fluid flow passage of the non-return valve and the pressure actuated valve is located downstream in the direction of fluid flow in the fluid flow passage of the pressure actuated piston device.

14. A tubular connector as claimed in claim 1, wherein the pressure required to actuate the pressure actuated piston device is greater than the pressure required to actuate the pressure actuated valve.

15. A tubular connector as claimed in claim 7, wherein the pressure actuated valve comprises a sleeve in the fluid flow passage including shear pins, the sleeve further including a flow restriction which includes a ball seat, the ball seat provided by the flow restriction is smaller than a restriction provided in the pressure actuated piston device.

16. A tubular connector as claimed in claim 1, wherein the drill string comprises coiled tubing.

17. A tubular connector as claimed in claim 1, wherein the drilling tool assembly comprises a downhole motor and a drill bit.

* * * * *